US011297931B2

(12) United States Patent
Booker

(10) Patent No.: US 11,297,931 B2
(45) Date of Patent: Apr. 12, 2022

(54) DENTAL CARE APPARATUS

(71) Applicant: BRUSHTIME ENTERPRISES, LLC, Owings Mills, MD (US)

(72) Inventor: Winifred J. Booker, Owings Mills, MD (US)

(73) Assignee: BRUSHTIME ENTERPRISES, LLC, Owings Mills, MD (US)

( * ) Notice: Subject to any disclaimer, the term of this patent is extended or adjusted under 35 U.S.C. 154(b) by 465 days.

(21) Appl. No.: 16/418,701

(22) Filed: May 21, 2019

(65) Prior Publication Data

US 2019/0357665 A1 Nov. 28, 2019

Related U.S. Application Data

(60) Provisional application No. 62/674,887, filed on May 22, 2018, provisional application No. 62/729,831, filed on Sep. 11, 2018.

(51) Int. Cl.

| | |
|---|---|
| ***A46B 9/04*** | (2006.01) |
| ***A46B 9/02*** | (2006.01) |
| ***A46B 7/04*** | (2006.01) |

(52) U.S. Cl.

CPC ..... *A46B 9/04* (2013.01); *A46B 7/04* (2013.01); *A46B 9/026* (2013.01); *A46B 2200/1066* (2013.01)

(58) Field of Classification Search

CPC .. A46B 9/04; A46B 7/04; A46B 9/026; A46B 2200/1066; A46B 15/0075;

(Continued)

(56) References Cited

U.S. PATENT DOCUMENTS 1,506,401 A * 8/1924 Young ..... A46B 15/0055 132/309
1,604,873 A * 10/1926 Barnhart ..... A46B 15/0077 132/309

(Continued)

FOREIGN PATENT DOCUMENTS

GB 426997 A * 4/1935 ..... A46B 15/0067
WO WO-2013129969 9/2013

OTHER PUBLICATIONS

International Search Report and Written Opinion issued by the 1SA/US for International Application No. PCT/US2019/033360, dated Aug. 27, 2019, 12 pages.

*Primary Examiner* — Weilun Lo
(74) *Attorney, Agent, or Firm* — Haynes and Boone, LLP

(57) ABSTRACT

A dental care apparatus including a head and a handle. The head includes a brush, a massager, and a guard. The brush and the massager extend from opposing side portions of the head. The massager includes a base and a plurality of projections extending from the base to stimulate oral tissue. The base is adapted to change in shape to conform to an interior surface of a mouth. The guard extends along a perimeter of the head to prevent, or at least reduce, traumatic contact with oral tissue. The handle includes an eating utensil and a cleaner. The eating utensil and the cleaner extend from opposing side portions of the handle. The eating utensil includes a reflective surface to facilitate visual inspection of an oral cavity and a bumper rim extending along a perimeter of the handle to circumferentially encase the reflective surface. The cleaner includes a plurality of projections.

18 Claims, 6 Drawing Sheets

(58) Field of Classification Search
CPC ..... A46B 15/0077; A46B 15/0081; A46B 15/0055; A61H 13/00
See application file for complete search history.

(56) References Cited

U.S. PATENT DOCUMENTS

| | | | | | |
|---|---|---|---|---|---|
| 2,028,519 | A | | 1/1936 | Peterkin et al. | |
| 2,139,593 | A | * | 12/1938 | Kohler | A46B 15/0077 15/167.1 |
| 2,241,584 | A | | 5/1941 | Cohen | |
| 2,473,773 | A | * | 6/1949 | West | A46B 15/00 15/110 |
| 5,044,948 | A | * | 9/1991 | Vance, Sr. | A46B 15/0055 433/31 |
| 5,778,475 | A | * | 7/1998 | Garcia | A46B 15/0055 15/111 |
| D423,786 | S | * | 5/2000 | Zelinski | A46B 15/0055 D4/105 |
| D654,695 | S | | 2/2012 | Jimenez et al. | |
| 2005/0091854 | A1 | * | 5/2005 | Johnson | A47G 21/00 30/324 |
| 2006/0195995 | A1 | * | 9/2006 | Moskovich | A46B 15/0002 15/111 |
| 2010/0107419 | A1 | * | 5/2010 | Crisp | A47G 21/12 30/147 |
| 2011/0308026 | A1 | | 12/2011 | Jimenez et al. | |
| 2016/0374462 | A1 | | 12/2016 | Huang | |
| 2017/0281207 | A1 | | 10/2017 | Ramos-Medina et al. | |
| 2017/0281208 | A1 | * | 10/2017 | Ramos-Medina | A46B 15/0081 |
| 2017/0367473 | A1 | * | 12/2017 | Jimenez | A46B 15/0081 |

* cited by examiner

DENTAL CARE APPARATUS

CROSS-REFERENCE TO RELATED APPLICATIONS

This application claims the benefit of the filing date of, and priority to, U.S. Patent Application No. 62/674,887, filed May 22, 2018, the entire disclosure of which is hereby incorporated herein by reference.

This application also claims the benefit of the filing date of, and priority to, U.S. Patent Application No. 62/729,831, filed Sep. 11, 2018, the entire disclosure of which is hereby incorporated herein by reference.

BACKGROUND

The present disclosure relates generally to dental care and, more particularly, to a dental care apparatus for providing comprehensive oral health care.

DETAILED DESCRIPTION

Figure 1:
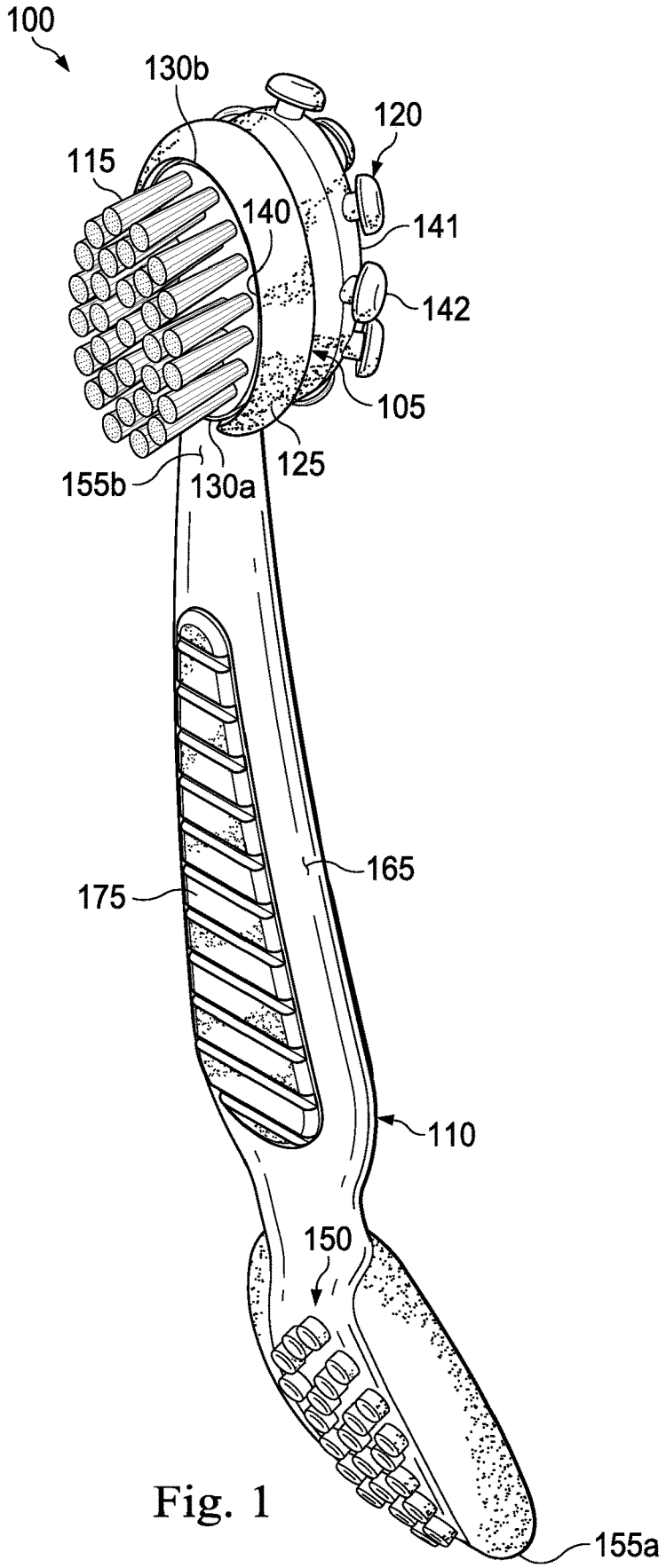
FIG. 1 is a perspective view of a dental care apparatus, according to one or more embodiments of the present disclosure.

Referring to FIGS. 1, 2A, 2B, 3A, 3B, 4A, 4B, 5, 6, 7, and 8, in an embodiment, a dental care apparatus is generally referred to by the reference numeral 100 and includes a head 105 and a handle 110. The dental care apparatus 100 has four (4) central parts, two (2) on each end of the handle 110. Moreover, the dental care apparatus 100 has eight (8) unique features that offer at least fourteen (14) uses, as will be described in further detail below. These uses range from brushing the teeth and viewing the dentition to providing nourishment, stimulating oral tissue, and encouraging speech development. The dental care apparatus 100 is enjoyably versatile and addresses many oral care challenges to help improve the human condition. Adults, children, differently-abled, and aging individuals can all experience the gratifying benefits of using the dental care apparatus 100. The dental care apparatus 100 offers the opportunity to better achieve comprehensive oral health care maintenance and management. The various components of the dental care apparatus 100 are ergonomically developed for effective and efficient routine oral care by adults and children age 1 and older. The dental care apparatus 100 may be provided in different sizes for the child/toddler and for the youth/adult.

Figure 4A:
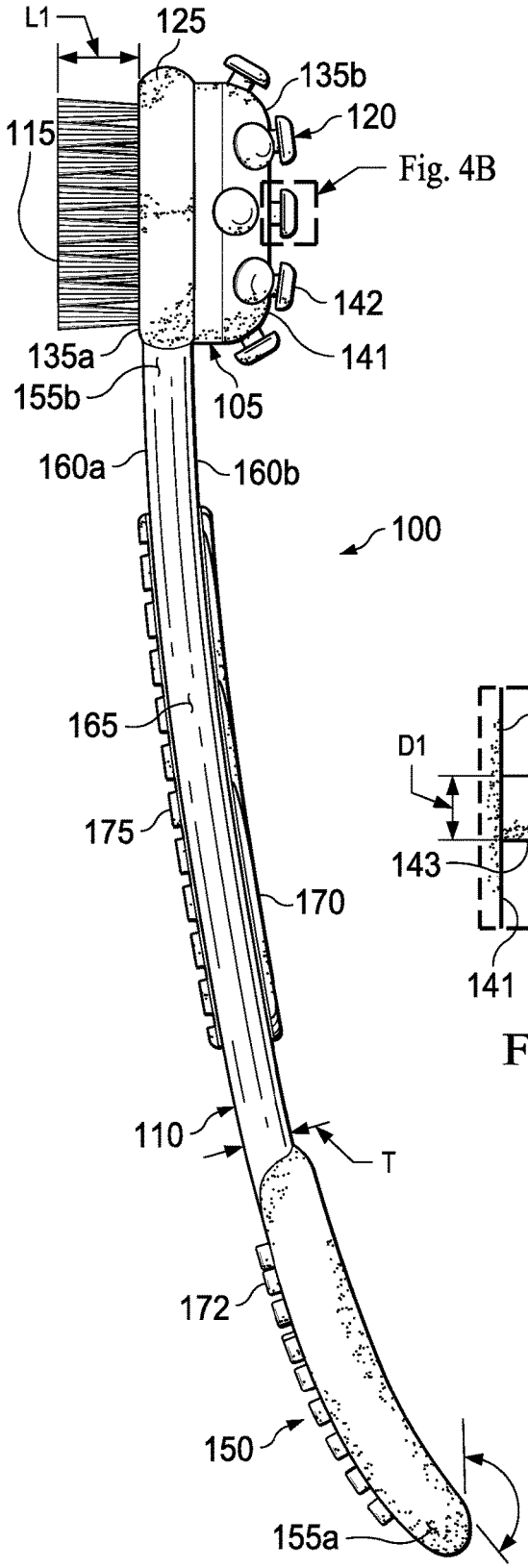
FIG. 4A is a left side elevational view of the dental care apparatus of FIG. 1, according to one or more embodiments of the present disclosure.

The head 105 includes a brush 115, a massager 120, and a guard 125. The head 105 is oblong. For example, the head 105 may be oval-shaped. The head 105 defines opposing end portions 130a and 130b (shown in FIGS. 2A and 2B), opposing side portions 135*a* and 135*b* (shown in FIGS. 4A and 5), and a perimeter portion 140 (shown in FIGS. 2A and 2B). The perimeter portion 140 extends around a periphery of the head 105 between the opposing side portions 135*a* and 135 *b*. The brush 115 is part of and/or extends from the side portion 135a of the head 105 and includes bristles made of a soft material such as, for example, nylon, vegetable, or the like. In several embodiments, the bristles are antibacterial. The bristles have a length L1, as shown in FIG. 4A. For example, the length L1 may be approximately 1 cm (+/−5%). The bristles of the brush 115 are usable to clean the teeth (e.g., using circular motions for 2 to 3 minutes on all tooth surfaces) and sweep away food particles and/or other residuals from the lips, gums, cheeks, tongue, and/or palate of a user and/or patient. In several embodiments, the dental care apparatus 100 may be designed for a child/toddler, in which case the dental care apparatus weighs approximately 13.5 grams. In several embodiments, the dental care apparatus 100 may be designed for a youth/adult, in which case the dental care apparatus weighs approximately 15.5 grams.

Figure 4B:
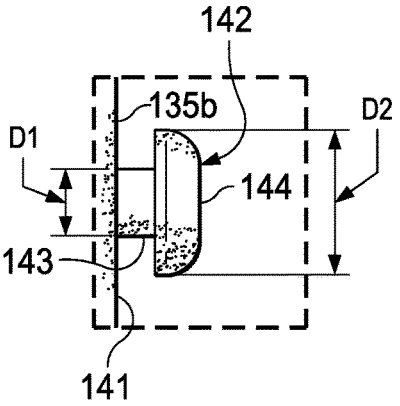
FIG. 4B is an enlarged left side elevational view of the dental care apparatus of FIG. 4A, according to one or more embodiments of the present disclosure.

The massager 120 is part of and/or extends from the side portion 135*b* of the head 105 and includes a base 141 and a plurality of projections 142 extending from the base 141, as shown in FIGS. 4A and 4B. In several embodiments, the massager 120 is made of food and/or surgical grade silicone. In several embodiments, the base 141 and the projections 142 are, include, or are part of a single cohesive construction that enables coordination of movement between the base 141 and the projections 142 during use of the dental care apparatus 100. The base 141 is oblong-shaped. For example, the base 141 may be oval-shaped. In addition, the base 141 is dome-shaped. In several embodiments, the base 141 is configured to change in shape in concert with the muscles of facial expression and the muscles of mastication as they contract and relax during use of the dental care apparatus 100. The projections 142 extending from the base 141 each include a stem 143 and a cap 144. The stem 143 has a dimension D1 (e.g., a diameter) (shown in FIG. 4B). The cap 144 has a dimension D2 (e.g., a diameter) (shown in FIG. 4B). The dimension D2 is greater than the dimension D1. In several embodiments, the projections 142 are mushroom-shaped. In several embodiments, the projections 142 are injection molded. In several embodiments, the projections 142 are asymmetrically distributed. In several embodiments, the massager 120 has child/toddler and youth/adult sizes. The massager 120 is usable to: stimulate oral tissue throughout the mouth including the lips, gums, cheek, tongue, and/or palate of a user and/or patient to improve food intake, swallowing, and speech; and/or cleanse food debris, fungal patches, microbial film, retained medications, and/or other unwanted materials from the cheek and palate areas (e.g., with gentle circular motions). As a result, the massager 120 helps the patient and/or user to build oral tone and improve a variety of speech, feeding, and sensory skills by expanding the sensory experience inside the oral cavity.

In operation, the head 105 of the dental care apparatus 100 is positionable in the space between the cheeks and the teeth so that the massager 120 extends into the cheeks and the brush 115 contacts the buccal surfaces of the teeth. Once so positioned, a back-and-forth motion is commenced to clean the teeth (using the brush 115) and to clean and stimulate the cheeks (using the massager 120) simultaneously. As the massager 120 cleans and stimulates the cheeks, the base 141 and the projections 142 conform to the anatomical and muscular composition of the cheeks. A level of synchronized mechanics is offered via these muscles in concert with the oblong-shaped head 105 during the act of brushing the teeth or massaging oral tissue. This coordinated movement helps to safely and effectively stimulate blood flow and remove food debris, fungus, and/or residual medications. Specifically, when the back-and-forth motion is commenced, the projections 142 wobble (via the stems 143 and the caps 144) to aid in the cleaning and stimulation of the cheeks. Such wobbling of the projections 142 improves blood flow to the cheeks, strengthens cheek muscles, and improves deglutition. Salivary flow may also be stimulated by the wobbling of the projections 142—studies have shown that the promotion of ductal secretions via massage may help to relieve a duct trapped with a salivary stone. In some instances, when the base 141 and the projections 142 are relaxed after conforming to the inside of the cheek, food particles that might otherwise pose a choking hazard are caught between the projections 142 for subsequent removal from the mouth. In addition, the base 141 and the projections 142 can conform to other parts of the mouth (e.g., the durable tissue density and the bony configuration of the hard palate) such that the wobbling of the projections 142 aids in the gentle disruption, collection, and removal of unwanted materials from such other parts of the mouth.

Figure 2A:
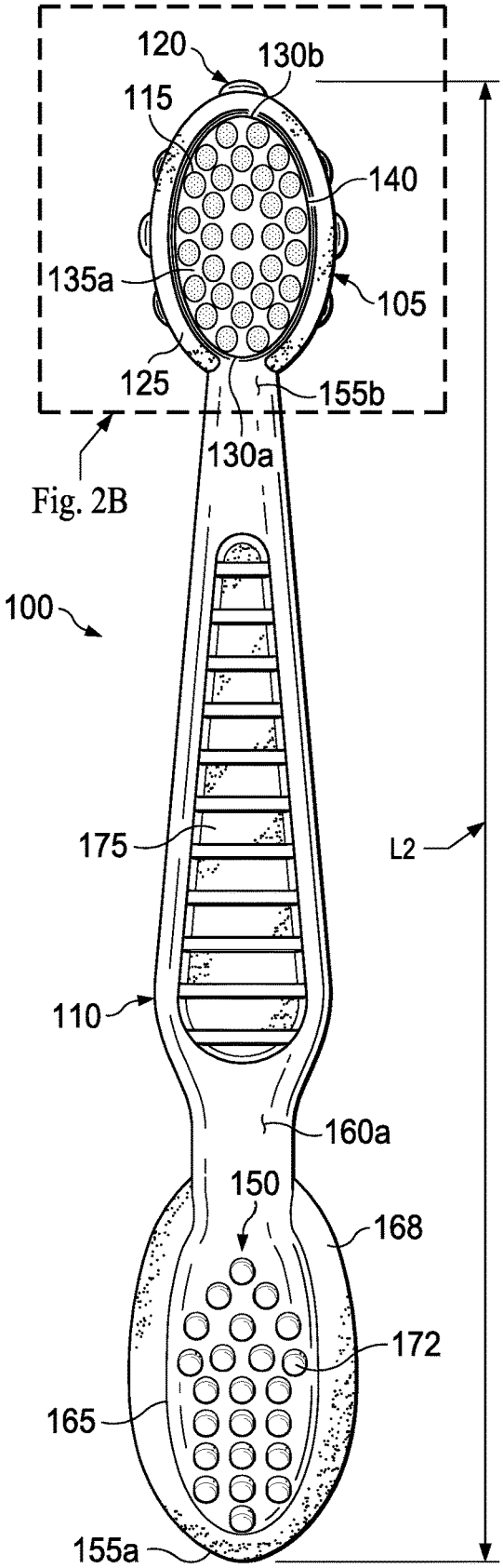
FIG. 2A is a front elevational view of the dental care apparatus of FIG. 1, according to one or more embodiments of the present disclosure.
Figure 3A:
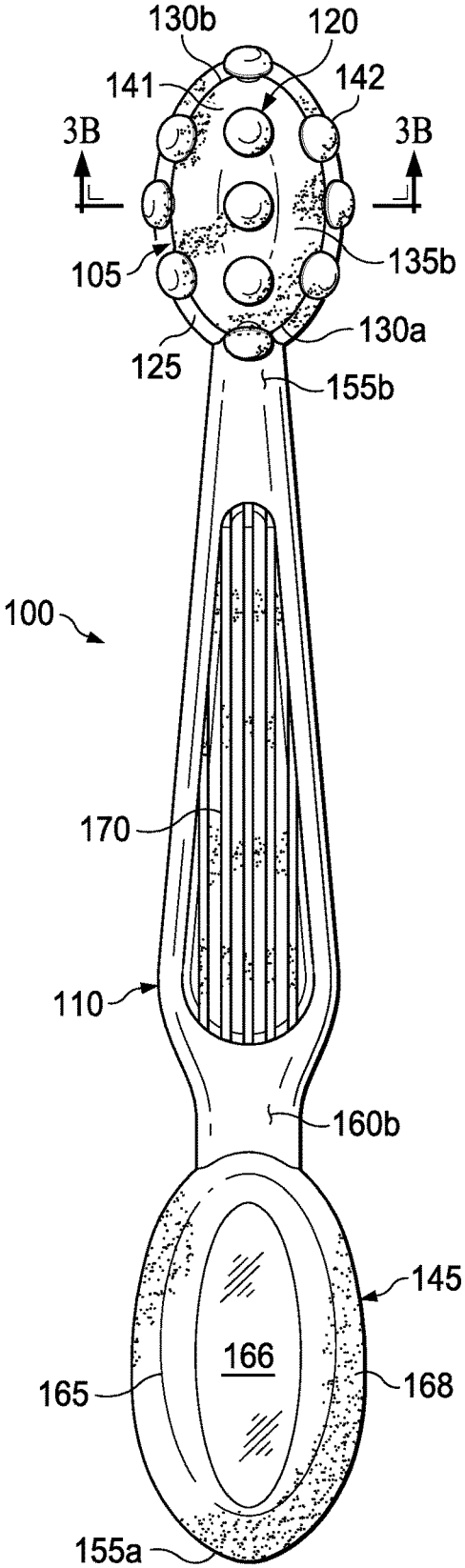
FIG. 3A is a rear elevational view of the dental care apparatus of FIG. 1, according to one or more embodiments of the present disclosure.
Figure 2B:
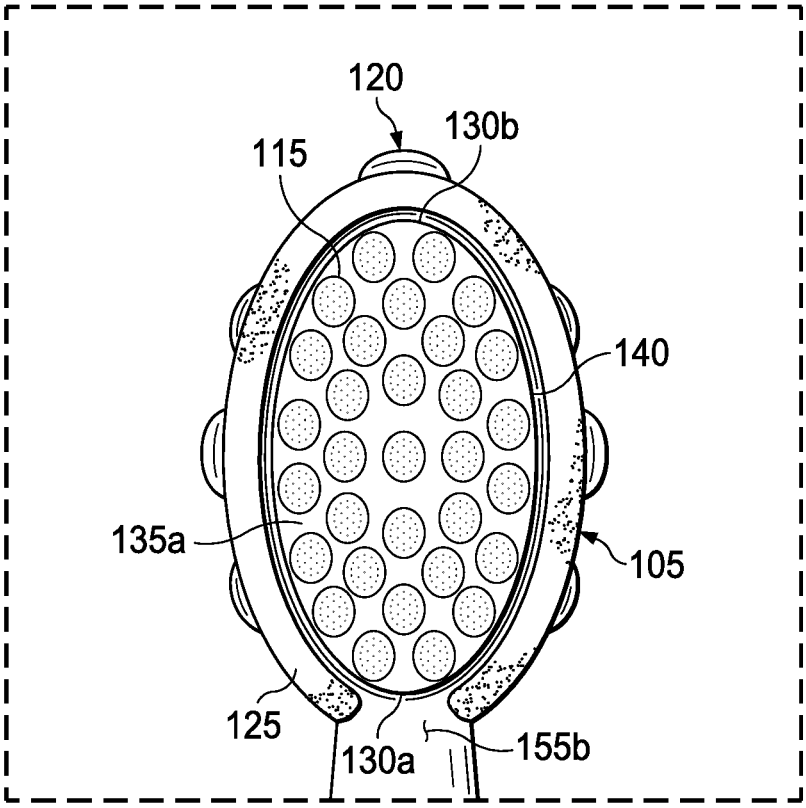
FIG. 2B is an enlarged front elevations view of the dental care apparatus of FIG. 2A, according to one or more embodiments of the present disclosure.
Figure 3B:
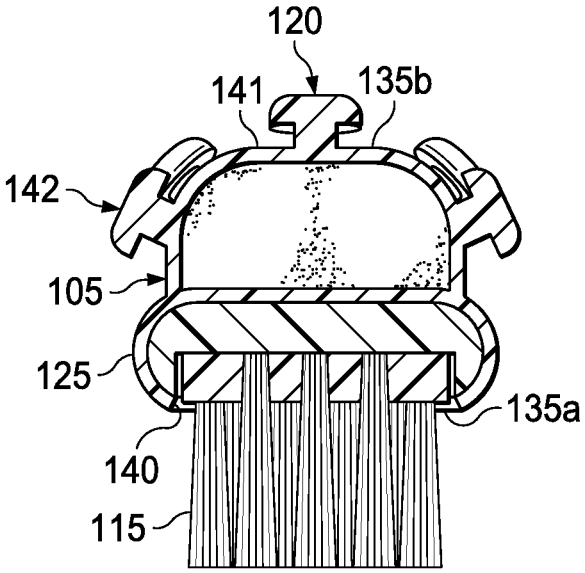
FIG. 3B is a cross-sectional view of the dental care apparatus taken along the line 3B-3B in FIG. 3A, according to one or more embodiments of the present disclosure.

The guard 125 extends along the perimeter portion 140 of the head 105 and serves as a transition to separate the brush 115 and the massager 120, as shown in FIGS. 2B and 3B. In several embodiments, the guard 125 defines a slight bulge. In several embodiments, the guard 125 is made of food and/or surgical grade silicone. For example, the guard 125 may be or include a cushion-like, circular band of resilient silicon. The guard 125 prevents, or at least reduces, traumatic contact (e.g., hematomas and other soft tissue injuries) between the head 105 and tissues throughout the mouth (e.g., both hard and soft oral structures) during use of the dental care apparatus 100. Specifically, the guard 125 permits only atraumatic tissue contact in the vestibular, retromolar, and cheek areas during use of the dental care apparatus 100. Moreover, the guard 125 reduces the potential for puncture or perforation injuries to the hard and soft palate and the oral pharyngeal structures during cleanings.

The handle 110 includes, is part of, and/or is coupled to an eating utensil 145 (e.g., a spoon) and a cleaner 150, as shown in FIGS. 1, 2A, 3A, and 8. The size, shape, and texture(s) of the eating utensil 145 and the cleaner 150, in combination, allows for easy feeding and oral stimulation. More particularly, the eating utensil 145 and the cleaner 150 offer soothing, enjoyable feeding and oral stimulation, affording the dental care apparatus 100 use as an adaptive feeding device, as will be described in further detail below. The handle 110 is ergonomically designed to couple the eating utensil 145 and the cleaner 150 to the head 105. The dental care apparatus 100 has a length L2. For example, the dental care apparatus 100 may be designed for a child/toddler, in which case the length L2 is approximately 15.5 cm (+/−5%). For another example, the dental care apparatus may be designed for a youth/adult, in which case the length L2 is approximately 17.5 cm (+/−5%). In several embodiments, a width of handle 110 is 1.7 cm. In several embodiments, a thickness T of the handle 110 is 600 Mils. In several embodiments, the handle is made of a Plastic #5—Polypropylene (PP).

The handle 110 defines opposing end portions 155*a* and 155*b* (shown in FIGS. 4A and 5), opposing side portions 160*a* and 160*b* (shown in FIGS. 4A and 5), and a perimeter portion 165 (shown in FIGS. 2A, 3A, and 4A). The perimeter portion 165 extends around a periphery of the handle 110 between the opposing side portions 160*a* and 160*b*. The end portion 155*b* of the handle 110 is connected to the end portion 130*a* of the head 105. The side portions 160*a* and 160*b* of the handle 110 are angularly aligned with the side portions 135*a* and 135*b* of the head 105. The handle 110 arches toward the side portion 160*b*. In several embodiments, the arch of the handle 110 toward the side portion 160*b* improves access to the mouth using the dental care apparatus 100. Due to the arch of the handle 110 toward the side portion 160*b*, the opposing end portions 155*a* and 155*b* extend at an angle $\alpha$ relative to one another, as shown in FIG. 4A. For example, the angle $\alpha$ may be approximately 170 degrees (+/−5%). For another example, the angle $\alpha$ may be: greater than 145 degrees, 150 degrees, 155 degrees, 160 degrees, or 165 degrees; and less than 175 degrees or 180 degrees. In several embodiments, the angle $\alpha$ offers an increased level of safety by affording the user the ability to grip the handle 110 itself, or to grip the handle 110 and the opposing wider end portion 155*a* together for added grasp security. As a result, multiple oral tissue areas and surfaces can be both efficiently accessed and effectively maintained using the handle 110 with the incorporation of the applicable and diverse features, as will be described in further detail below. In several embodiments, the angle $\alpha$ supports motor skill versatility by affording safety and effectiveness to cleanse the mouth based on the capabilities of diverse users.

Figure 6:
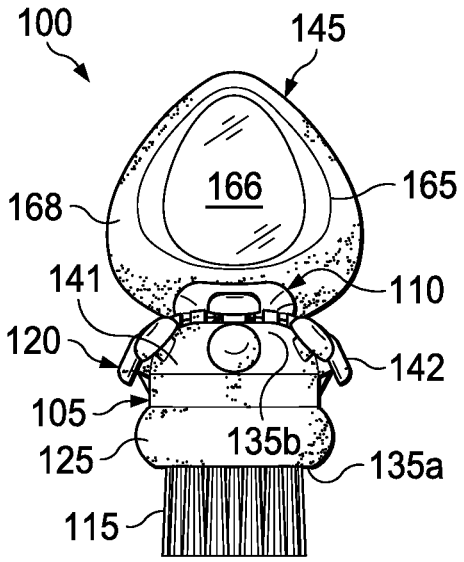
FIG. 6 is a top plan view of the dental care apparatus of FIG. 1, according to one or more embodiments of the present disclosure.
Figure 7:
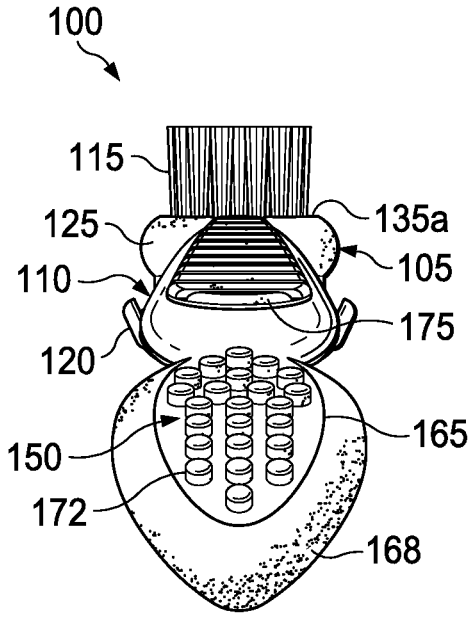
FIG. 7 is a bottom plan view of the dental care apparatus of FIG. 1, according to one or more embodiments of the present disclosure.
Figure 8:
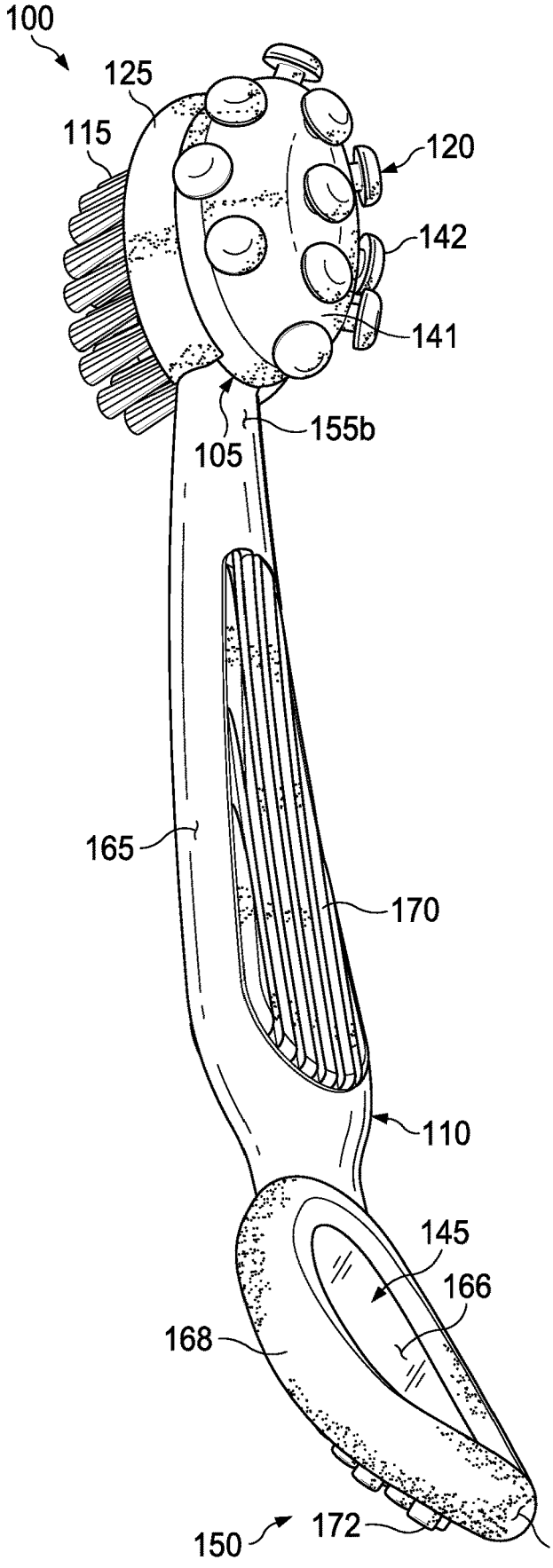
FIG. 8 is another perspective view of the dental care apparatus of FIG. 1, according to one or more embodiments of the present disclosure.

The eating utensil 145 is part of and/or extends from the side portion 160*b* of the handle 110 at the end portion 155*a*, as shown in FIGS. 3A, 6, and 8. In several embodiments, the eating utensil 145 is concave. For example, the eating utensil 145 may have an internal volume of 1 mL. For another example, the eating utensil 145 may have an internal volume of: greater than 0.5 mL, 0.6 mL, 0.7 mL, 0.8 mL, or 0.9 mL; and less than 1.5 mL, 1.4 mL, 1.3 mL, 1.2 mL, or 1.1 mL. In several embodiments, the eating utensil 145 is oblong-shaped. For example, the eating utensil 145 may be oval-shaped. The eating utensil 145 allows small portions of food or medicine to be delivered to the mouth. In several embodiments, the eating utensil 145 prevents, or at least reduces, texture aversions. As will be described in further detail below, the eating utensil 145 is usable as: a feeding spoon to deliver food to the mouth; a dental mirror to visually inspect the mouth; a teething and/or comfort chewing ring; and a mouth prop to assist in opening the mouth when gently placed between the upper and lower teeth.

The eating utensil 145 includes a reflective surface 166 and a bumper rim 168. In several embodiments, the reflective surface 166 is made of stainless steel. The reflective surface 166 of the eating utensil 145 (e.g., a spoon) doubles as a dental mirror that facilitates visibility inside of the mouth for examination of the teeth and oral tissue. In several embodiments, the reflective surface 166 is oblong-shaped to enable inspection of the mouth in both the longitudinal and lateral planes of the eating utensil 145. The bumper rim 168 circumferentially encases the reflective surface 166 and extends along the perimeter portion 165 at the end portion 155*a* of the handle 110. In several embodiments, the bumper rim 168 is injection molded over the end portion 155a of the handle 110 and around the reflective surface 166. In several embodiments, the bumper rim 168 is made of food and/or surgical grade silicone. The bumper rim 168 extends from the side portion 160*a* to the side portion 160*b* of the handle 110 to provide a definitive measure of tissue protection. The bumper rim 168 serves both as a mouth prop and a (de facto) teething/comfort chewing ring (i.e., should teething or comfort chewing occur while in use). However, the bumper rim 168 should be used only to support comfort chewing or teething; should either behavior begin while in use, the dental care apparatus 100 should be promptly and slowly removed from the mouth to avoid injury or aggressive biting/tearing any of the silicone parts. In addition, the bumper rim 168 supports the contents of this shallow spoon and minimizes tooth contact with the end portion 155*a* of the handle 110 and/or the reflective surface 166 when the dental care apparatus 100 is in use.

Figure 5:
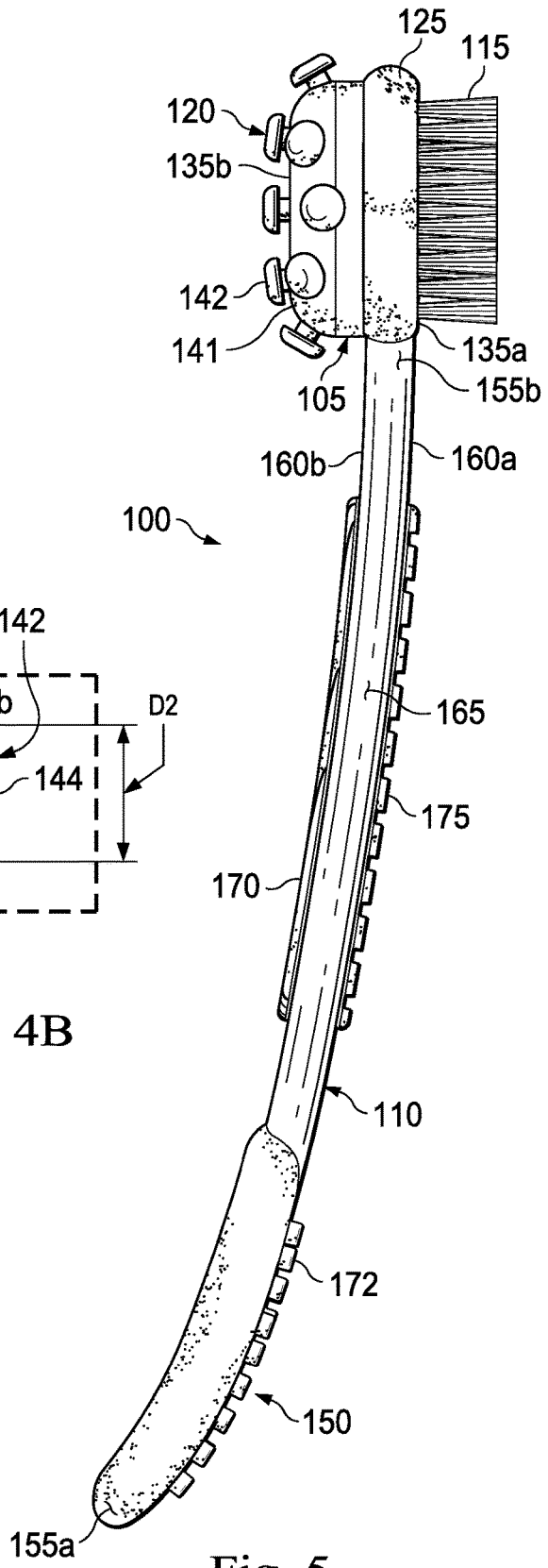
FIG. 5 is a right side elevational view of the dental care apparatus of FIG. 1, according to one or more embodiments of the present disclosure.

The handle 110 also includes a grip 170 that is part of and/or extends from the side portion 160*b*, as shown in FIGS. 3A, 4A, and 5. The grip 170 extends between the end portions 155*a* and 155*b* of the handle 110 and includes longitudinally-extending ridges and grooves. Such longitudinally-extending ridges and grooves prevent, or at least reduce, slippage of the dental care apparatus 100 and possible traumas during use. In several embodiments, the grip 170 is made of food and/or surgical grade rubber. While the primary function of the grip 170 is for grip control of the dental care apparatus 100, the grip 170 can also serve a secondary tongue care function, namely, to clean or stimulate the oral sensory complexes should licking occur.

The cleaner 150 is part of and/or extends from the side portion 160*a* of the handle 110 at the end portion 155*a*, as shown in FIGS. 1, 2A, 4A, 5, and 7. In several embodiments, the cleaner 150 is oblong-shaped. For example, the cleaner 150 may be oval-shaped. The cleaner 150 includes a plurality of projections 172. In several embodiments, the projections 172 are textured. In several embodiments, the projections 172 are cylinder-shaped. In several embodiments, the projections have child/toddler and youth/adult sizes. In several embodiments, the projections 172 are injection molded. In several embodiments, the projections 172 are made of food and/or surgical grade silicone. The cleaner 150 is usable as: a tongue cleaner if moved back and forth over the tongue to remove food debris, biofilm, and residual medication coating; a taste bud stimulator; an oral sensorimotor stimulator to improve food intake, swallowing, and speech; a tongue depressor; and a cheek retractor to allow access and visibility into the mouth if placed inside the cheek and gently pulled back.

More particularly, the projections 172: support gently cleaning the tongue to reduce the bacterial load harbored by the tongue; serve as an oral/motor stimulator feature capable of stimulating the taste buds, sensory mechanisms, and other oral tissue (such tactile stimulation by the projections 172 can support the transition from pureed food to textured food and provide stability for the tongue); and/or are usable to stimulate the upper lip, the lower lip, the tongue, or any combination thereof. In addition, the cleaner 150 allows for gentle depression (pressure) of the tongue and affords a level of oral motor exercise (OME) that is useful to encourage tongue elevation, tongue lateralization, and tongue bowl maneuvers. These OMEs support masticatory performance and swallow training which are necessary for improved swallowing and speech. The end portion 155*a* of the handle 110 also allows for retraction of the cheeks and aids in the inspection of the throat and tonsils. The angle $\alpha$ of the handle 110 supports both depression of the tongue and retraction of the cheeks. In addition, the end portion 155*a* of the handle 110 is usable as a mouth prop when inserted vertically between the upper and lower teeth (anterior or posterior). In this position, the end portion 155*a* of the handle 110 prevents the mouth from closing and/or affords fastidious maneuvering at the corners of the mouth to facilitate a comfortable and easy entry into the mouth for inspection of the oral cavity, throat, and teeth.

The handle 110 also includes a grip 175 that is part of and/or extends from the side portion 160*a*, as shown in FIGS. 2A, 4A, and 5. The grip 175 extends between the end portions 155*a* and 155*b* and includes transversely-extending ridges and grooves. Such transversely-extending ridges and grooves prevent, or at least reduce, slippage of the dental care apparatus 100 and possible traumas during use. In several embodiments, the grip 175 is made of food and/or surgical grade rubber. While the primary function of the grip 175 is for grip control of the dental care apparatus 100, the grip 175 can also serve a secondary tongue care function, namely, to clean or stimulate the oral sensory complexes should licking occur.

In several embodiments, the massager 120 and/or the cleaner 150 is/are also usable to: clean dental appliances (e.g., acrylic appliances) by removing food without scratching or otherwise damaging the appliance. The massager 120 is especially efficient in cleansing appliances that conform to the shape of the palate such as complete dentures, obturators, and other removable adult, pediatric, and orthodontic appliances. Specifically, hard-to-reach areas where bacteria collect can be efficiently cleansed using the massager 120. Moreover, the silicone material from which the massager 120 and/or the cleaner 150 is/are made prevents, or at least reduces, damage to such dental appliances, unlike toothbrush bristles which can damage and scratch acrylics.

As discussed herein, the dental care apparatus 100 enables at least the following operational features/components: hand grips, an eating utensil, a dental mirror, a teething/comfort chewing ring, a mouth prop, a tongue cleaner, a tongue depressor, a cheek retractor, an adaptive feeding device, an oral/motor stimulator, a toothbrush, a tissue guard, a tissue massager, and/or an appliance cleaner. Each of these different features/components can stand alone independently but can also be used together for the general purpose of comprehensive oral health management. Thus, the dental care apparatus 100 offers dynamic functional uses on both sides 135*a* and 135*b* of the head 105 and both sides 160*a* and 160*b* of the handle 110, which uses have been methodically developed to help execute the fundamentals of good oral health maintenance. In some instances, the dental care apparatus 100 can decrease oral defensiveness and improve tolerance of food textures in the mouth.

Since the dental care apparatus 100 offers an opportunity to better achieve comprehensive oral health care maintenance and management, adults, children, special needs individuals, and aging individuals can all experience measurable benefits using the dental care apparatus 100. However, children, persons with special needs, and/or infirmed or elderly persons should never be left unattended when oral hygiene care is being addressed and must always be supervised when using the dental care apparatus 100. The various features/components of the dental care apparatus 100 are ergonomically configured for an effective and efficient or health care routine. Specifically, the ergonomic design of the dental care apparatus 100 is intended to provide improved levels of comprehensive oral health management and maintenance for adults, infants as young as eight (8) months old, toddlers, special needs persons, and/or persons with infirmities (e.g., elderly persons).

Finally, so many circumstances exist inside of the mouth that support the usefulness of the design elements of the dental care apparatus 100. The versatility and varied functions can be especially helpful for babies, adults and other patient populations. The (1) elderly, (2) immunosuppressed, (3) facial burn victims, (4) Bell's Palsy patient, (5) individuals with craniofacial syndromes, (6) ventilated patients, (7) post-ventilated patients, (8) patients recovering from oral surgery or broken jaw fixation appliances, and (9) others who may be differently-abled can all reap the many benefits of improved oral health maintenance using the dental care apparatus 100. A healthy mouth is not just about the teeth. It is about diet, eating, swallowing, speaking, health maintenance, and health education. The functionally-diverse dental care apparatus 100 provides for oral health care education, maintenance, and management. The teeth, tongue, cheeks, palate and gingiva can all be easily and efficiently cleaned, swallowing exercised, speech development assisted, and oral appliances preserved safely and effectively using the dental care apparatus 100. The dental care apparatus 100 is an age-appropriate and circumstances-appropriate oral health care product that provides the opportunity to promote healthy behaviors at the point of care.

Attached hereto is an Appendix that includes Figures A through H. Specifically, in several embodiments, one or more of the embodiments of the present application are provided in whole or in part as described and illustrated in the Appendix, which forms part of the present application. Moreover, Figures A through H provide additional support for any U.S. or non-U.S. design applications that are to be filed in the future claiming priority to this present U.S. utility patent application. Figures A through H are similar to FIGS. 1-4A and 5-8, respectively, but Figures A through H do not include the reference numerals shown in FIGS. 1-4A and 5-8. More particularly, in the Appendix:

Figure A is a perspective view of a new, original design for a dental care device;

Figure B is a front elevational view thereof;

Figure C is a rear elevational view thereof;

Figure D is a left side elevational view thereof;

Figure E is a right side elevational view thereof;

Figure F is a top plan view thereof;

Figure G is a bottom plan view thereof; and

Figure H is another perspective view thereof.

In several embodiments, one or more of the embodiments described and illustrated in the Appendix are combined in whole or in part with one or more of the embodiments described above, illustrated in one or more of FIGS. 1 through 27, one or more other embodiments described and illustrated in the Appendix, or any combination thereof.

A first dental care apparatus has been disclosed. The first dental care apparatus generally includes: a head defining opposing first and second end portions, opposing first and second side portions, and a first perimeter portion extending around a first periphery of the head between the opposing first and second side portions, wherein the head includes a brush that is part of and/or extends from the first side portion of the head; and a handle defining opposing third and fourth end portions, opposing third and fourth side portions, and a second perimeter portion extending around a second periphery of the handle between the opposing third and fourth side portions, wherein the third end portion of the handle is coupled to the second end portion of the head, and wherein the handle includes an eating utensil that is part of and/or extends from the fourth side portion of the handle proximate the fourth end portion of the handle.

The foregoing apparatus embodiment may include one or more of the following elements, either alone or in combination with one another:

- The opposing third and fourth side portions of the handle are angularly aligned with the opposing first and second side portions, respectively, of the head.
- The handle further includes a cleaner that is part of and/or extends from the third side portion of the handle proximate the fourth end portion of the handle; and the cleaner includes a plurality of projections.
- The eating utensil includes a surface and a bumper rim extending along the second perimeter portion proximate the fourth end portion of the handle to circumferentially encase the surface.
- The surface is reflective to facilitate visual inspection of an oral cavity.
- The handle arches toward the fourth side portion such that the opposing third and fourth end portions of the handle extend at an angle relative to one another.
- The head further includes a massager that is part of and/or extends from the second side portion of the head; the massager includes a base and a plurality of projections extending from the base and being adapted to stimulate oral tissue; the plurality of projections extending from the base each include a proximal stem having a first dimension and a distal cap having a second dimension; and the second dimension is greater than the first dimension.
- The head further includes a massager that is part of and/or extends from the second side portion of the head; the massager includes a base and a plurality of projections extending from the base and being adapted to stimulate oral tissue; and the base is adapted to change in shape to conform to an interior surface of a mouth.
- The head further includes a guard extending along the first perimeter portion of the head to prevent, or at least reduce, traumatic contact with oral tissue; and the guard defines a bulge and/or is made of a resilient material.

A second dental care apparatus has also been disclosed. The second dental care apparatus generally includes: a head defining opposing first and second end portions, opposing first and second side portions, and a perimeter portion extending around a periphery of the head between the opposing first and second side portions, wherein the head includes a brush that is part of and/or extends from the first side portion of the head, and wherein the head further includes: a massager that is part of and/or extends from the second side portion of the head; and/or a guard extending along the perimeter portion of the head to prevent, or at least reduce, traumatic contact with oral tissue; and a handle coupled to the head.

The foregoing apparatus embodiment may include one or more of the following elements, either alone or in combination with one another:

- The head includes the massager that is part of and/or extends from the second side portion of the head; the massager includes a base and a plurality of projections extending from the base and being adapted to stimulate oral tissue; the plurality of projections extending from the base each include a proximal stem having a first dimension and a distal cap having a second dimension; and the second dimension is greater than the first dimension.

The head includes the massager that is part of and/or extends from the second side portion of the head; the massager includes a base and a plurality of projections extending from the base and being adapted to stimulate oral tissue; and the plurality of projections extending from the base are each mushroom-shaped.

The head includes the massager that is part of and/or extends from the second side portion of the head; the massager includes a base and a plurality of projections extending from the base and being adapted to stimulate oral tissue; and the base is dome-shaped.

The head includes the massager that is part of and/or extends from the second side portion of the head; the massager includes a base and a plurality of projections extending from the base and being adapted to stimulate oral tissue; and the base is adapted to change in shape to conform to an interior surface of a mouth.

The head includes the guard extending along the perimeter portion of the head to prevent, or at least reduce, traumatic contact with oral tissue; and the guard defines a bulge and/or is made of a resilient material.

A third dental care apparatus has also been disclosed. The third dental care apparatus generally includes: a head; and a handle defining opposing first and second end portions, opposing first and second side portions, and a perimeter portion extending around a periphery of the handle between the opposing first and second side portions, wherein the first end portion of the handle is coupled to the head, and wherein the handle includes: a cleaner that is part of and/or extends from the first side portion of the handle proximate the second end portion of the handle; and/or an eating utensil that is part of and/or extends from the second side portion of the handle proximate the second end portion of the handle.

The foregoing apparatus embodiment may include one or more of the following elements, either alone or in combination with one another:

The dental care apparatus includes the cleaner; and the cleaner includes a plurality of projections.

The dental care apparatus includes the eating utensil; and the eating utensil includes a surface and a bumper rim extending along the perimeter portion proximate the second end portion of the handle to circumferentially encase the surface; and the eating utensil is concave.

The dental care apparatus includes the eating utensil; and the eating utensil includes a surface and a bumper rim extending along the perimeter portion proximate the second end portion of the handle to circumferentially encase the surface; and the surface is reflective to facilitate visual inspection of an oral cavity.

The handle arches toward the second side portion such that the opposing first and second end portions of the handle extend at an angle relative to one another.

It is understood that variations may be made in the foregoing without departing from the scope of the present disclosure.

In several embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several embodiments, while different steps, processes, methods, and procedures are described as appearing as distinct acts, one or more of the steps, one or more of the processes, one or more of the methods, and/or one or more of the procedures may also be performed in different orders, simultaneously and/or sequentially. In several embodiments, the steps, processes, methods, and/or procedures may be merged into one or more steps, processes, methods, and/or procedures.

In several embodiments, one or more of the steps of any of the above-described methods may be omitted. In several embodiments, one or more of the operational steps in each embodiment may be omitted. Moreover, in some instances, some features of the present disclosure may be employed without a corresponding use of the other features. Moreover, one or more of the embodiments disclosed above and in the Appendix, or variations thereof, may be combined in whole or in part with any one or more of the other embodiments described above and in the Appendix, or variations thereof.

Although several embodiments have been described in detail above and in the Appendix, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A dental care apparatus, comprising:

a head defining opposing first and second end portions, opposing first and second side portions, and a first perimeter portion extending around a first periphery of the head between the opposing first and second side portions, wherein the head comprises:

a brush positioned at the first side portion of the head; and a massager positioned at the second side portion of the head, the massager comprising:

a base adapted to change in shape to conform to an interior surface of a mouth; and a plurality of projections extending from the base and adapted to stimulate oral tissue;

and a handle defining opposing third and fourth end portions, opposing third and fourth side portions, and a second perimeter portion extending around a second periphery of the handle between the opposing third and fourth side portions, wherein the third end portion of the handle is coupled to the second end portion of the head, and wherein the handle comprises an eating utensil positioned at the fourth side portion of the handle proximate the fourth end portion of the handle.

2. The dental care apparatus of claim 1, wherein the opposing third and fourth side portions of the handle are angularly aligned with the opposing first and second side portions, respectively, of the head.

3. The dental care apparatus of claim 1, wherein the handle further comprises a cleaner positioned at the third side portion of the handle proximate the fourth end portion of the handle; and wherein the cleaner comprises a plurality of projections.

4. The dental care apparatus of claim 1, wherein the eating utensil comprises a surface and a bumper rim extending along the second perimeter portion proximate the fourth end portion of the handle to circumferentially encase the surface.

5. The dental care apparatus of claim 4, wherein the surface is reflective to facilitate visual inspection of an oral cavity.

6. The dental care apparatus of claim 1, wherein the handle arches toward the fourth side portion such that the opposing third and fourth end portions of the handle extend at an angle relative to one another.

7. The dental care apparatus of claim 1, wherein the plurality of projections extending from the base each include a proximal stem having a first dimension and a distal cap having a second dimension; and wherein the second dimension is greater than the first dimension.

8. The dental care apparatus of claim 1, wherein the head further comprises a guard extending along the first perimeter portion of the head to prevent, or at least reduce, traumatic contact with oral tissue; and wherein the guard defines a bulge and/or is made of a resilient material.

9. A dental care apparatus, comprising:

a head defining opposing first and second end portions, opposing first and second side portions, and a perimeter portion extending around a periphery of the head between the opposing first and second side portions, wherein the head comprises:

a brush positioned at the first side portion of the head; and a massager positioned at the second side portion of the head, the massager comprising:

a base adapted to change in shape to conform to an interior surface of a mouth: and a plurality of projections extending from the base and adapted to stimulate oral tissue;

and a handle coupled to the head.

10. The dental care apparatus of claim 9, wherein the plurality of projections extending from the base each include a proximal stem having a first dimension and a distal cap having a second dimension; and wherein the second dimension is greater than the first dimension.

11. The dental care apparatus of claim 9, wherein the plurality of projections extending from the base are each mushroom-shaped.

12. The dental care apparatus of claim 9, wherein the base is dome-shaped.

13. The dental care apparatus of claim 9, wherein the head further comprises a guard extending along the perimeter portion of the head to prevent, or at least reduce, traumatic contact with oral tissue; and wherein the guard defines a bulge and/or is made of a resilient material.

14. A dental care apparatus, comprising:

a head; and a handle defining opposing first and second end portions, opposing first and second side portions, and a perimeter portion extending around a periphery of the handle between the opposing first and second side portions, wherein the first end portion of the handle is coupled to the head, and wherein the handle comprises:

a cleaner positioned at the first side portion of the handle proximate the second end portion of the handle; and/or an eating utensil positioned at the second side portion of the handle proximate the second end portion of the handle;

wherein the head comprises a massager;

wherein the massager comprises a base and a first plurality of projections extending from the base and being adapted to stimulate oral tissue; and wherein the base is adapted to change in shape to conform to an interior surface of a mouth.

15. The dental care apparatus of claim 14, wherein the handle comprises the cleaner; and wherein the cleaner comprises a second plurality of projections.

16. The dental care apparatus of claim 14, wherein the handle comprises the eating utensil;

wherein the eating utensil comprises a surface and a bumper rim extending along the perimeter portion proximate the second end portion of the handle to circumferentially encase the surface; and wherein the eating utensil is concave.

17. The dental care apparatus of claim 14, wherein the handle comprises the eating utensil;

wherein the eating utensil comprises a surface and a bumper rim extending along the perimeter portion proximate the second end portion of the handle to circumferentially encase the surface; and wherein the surface is reflective to facilitate visual inspection of an oral cavity.

18. The dental care apparatus of claim 14, wherein the handle arches toward the second side portion such that the opposing first and second end portions of the handle extend at an angle relative to one another.

* * * * *